US005482179A

United States Patent [19]

Bruhn

[11] Patent Number: 5,482,179

[45] Date of Patent: Jan. 9, 1996

[54] PACK FOR LIQUIDS WITH BAG

[75] Inventor: Krister Bruhn, Seeheim-Jungenheim, Germany

[73] Assignee: Tetra Layal Holdings & Finance S.A., Pully, Switzerland

[21] Appl. No.: 184,658

[22] Filed: Jan. 21, 1994

[30] Foreign Application Priority Data

Jan. 22, 1993 [DE] Germany ..... 43 01 620.0

[51] Int. Cl.[6] ..... B65D 5/56

[52] U.S. Cl. ..... 220/410; 220/401; 220/462; 220/465; 220/668; 229/162; 383/19

[58] Field of Search ..... 229/125.04, 125.15, 229/162; 383/119; 220/401, 408, 410, 461, 462, 465, 661, 662, 668, 676

[56] References Cited

U.S. PATENT DOCUMENTS

| | | | |
|---|---|---|---|
| 2,713,453 | 7/1955 | Williamson | 229/162 |
| 2,951,628 | 9/1960 | Grussen | 220/461 |
| 3,082,864 | 3/1963 | Silver | 220/410 |
| 3,119,546 | 1/1964 | Wuerthner | 229/162 |
| 3,223,233 | 12/1965 | Becker et al. | 383/119 |
| 3,272,423 | 9/1966 | Bjarno | 229/55 |
| 3,521,807 | 7/1970 | Weisberg | 220/461 |
| 3,542,566 | 11/1970 | Wakefield | 383/119 |
| 3,640,381 | 2/1972 | Kanada et al. | 383/119 |
| 4,214,675 | 7/1980 | Schmit | 222/83 |
| 4,367,842 | 1/1983 | Rausing | 383/119 |
| 4,741,073 | 5/1988 | Capen | 16/114 R |
| 4,948,036 | 8/1990 | Loughman | 229/162 |
| 5,096,306 | 3/1992 | Stenstrom et al. | 220/462 |
| 5,147,062 | 9/1992 | Heuberger et al. | 220/410 |

FOREIGN PATENT DOCUMENTS

| | | | |
|---|---|---|---|
| 2587978 | 9/1985 | France . | |
| 3717898 | 5/1987 | Germany . | |
| 8813179 | 10/1988 | Germany . | |
| 9000317 | 1/1990 | Germany . | |
| 4025211 | 8/1990 | Germany . | |
| 4120048 | 6/1991 | Germany . | |
| 651804 | 4/1951 | United Kingdom | 383/119 |

*Primary Examiner*—Gary E. Elkins
*Attorney, Agent, or Firm*—Biebel & French

[57] ABSTRACT

A pack for liquids has a supportive covering and a flexible bag which is arranged therein with a closable pouring device. The supportive covering has a bottom, a side wall and a top wall. So that a pack of this kind is practical and easy to handle, able to be distributed well and is economical to manufacture and is made of materials which can already be recycled and which are, above all, able to be recycled, it is provided that the supportive covering is in the form of a rigid frame. The top wall of the frame has a flat first wall zone which is parallel to the flat bottom and a flat second wall zone which is disposed at an angle thereto. The first and second wall zones are disposed adjacent to each other along a first broken line. The second wall zone is joined to the bottom by way of the side wall and the first wall zone is joined to the bottom by way of a limb. The second wall zone which is disposed at an angle has a hole for passage therethrough of the pouring device arranged on the bag, and the bag is secured to the second wall zone and also to the bottom.

12 Claims, 16 Drawing Sheets

Figure 1:
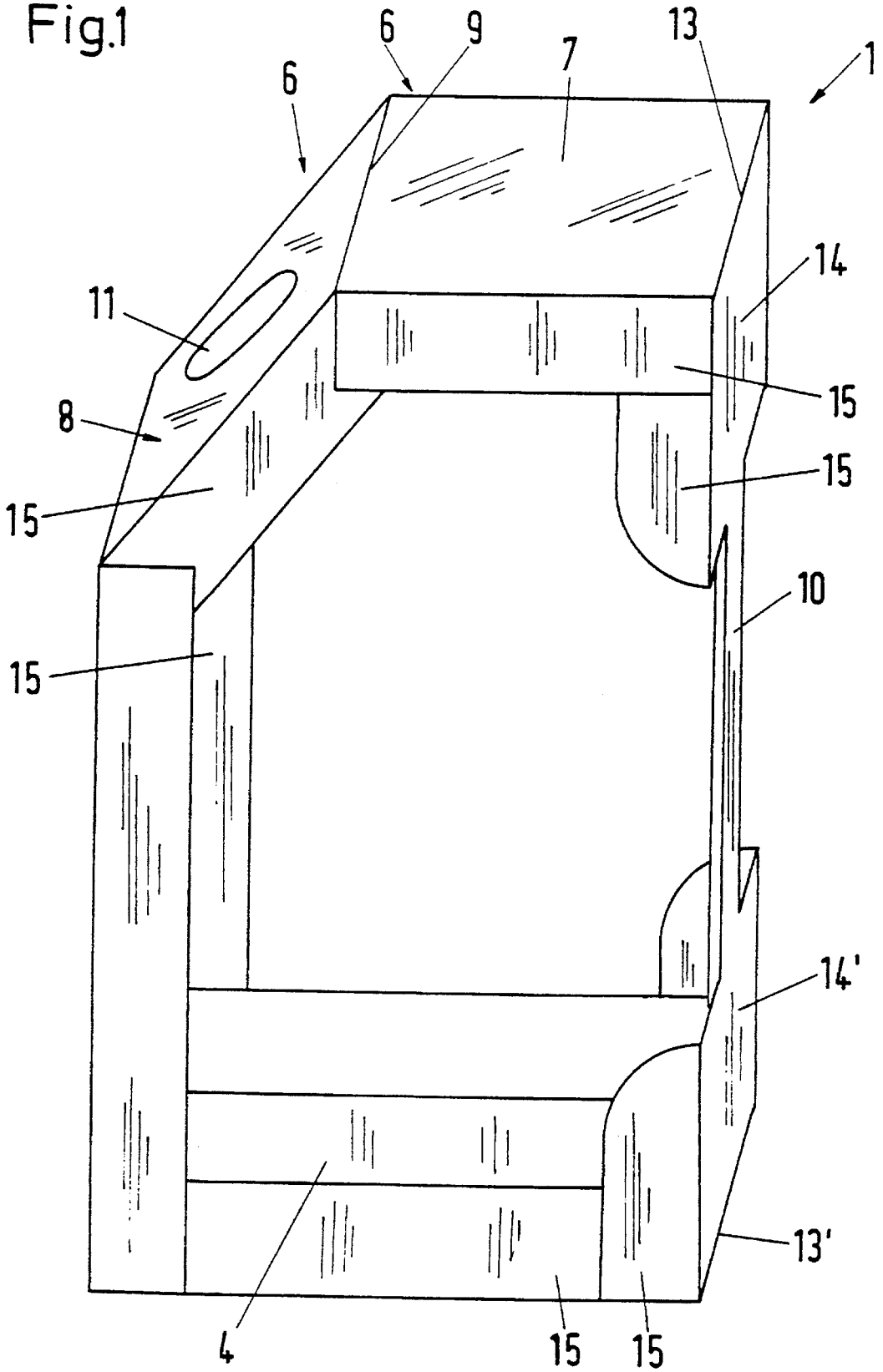

Fig. 2a
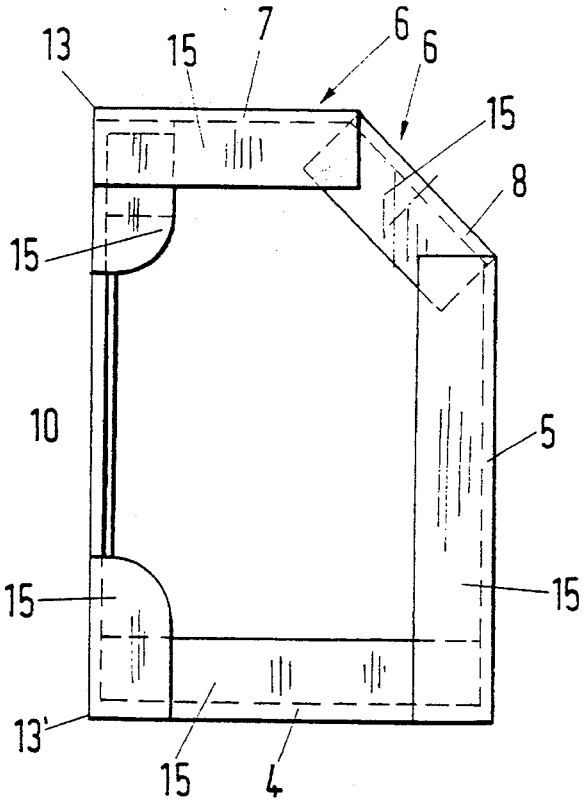
Fig. 2b
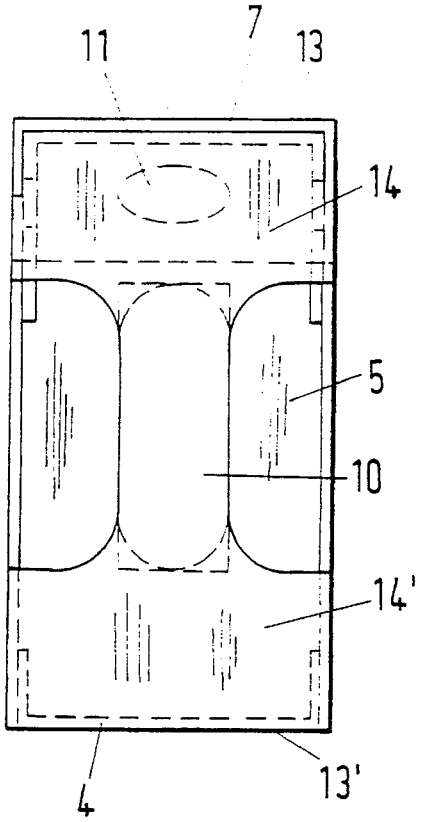
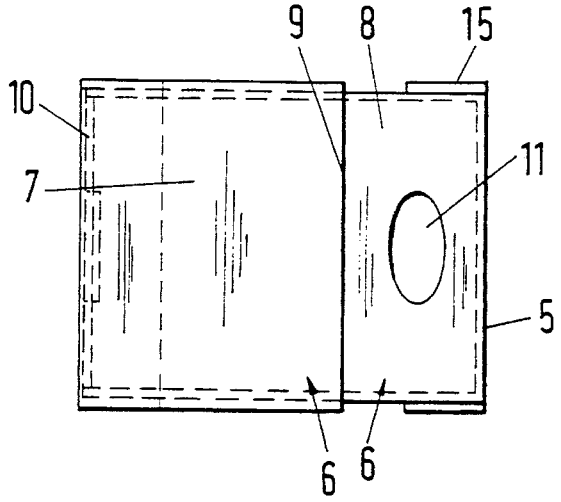
Fig. 2c

Fig.6a
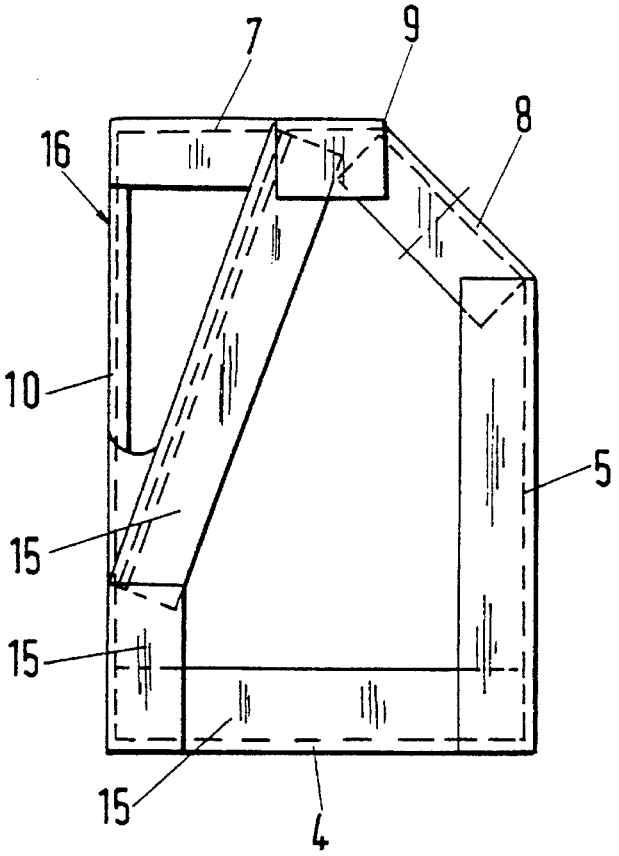
Fig.6b
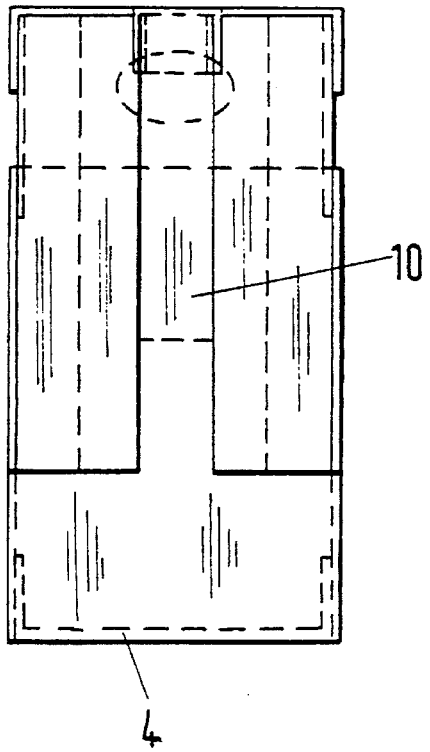
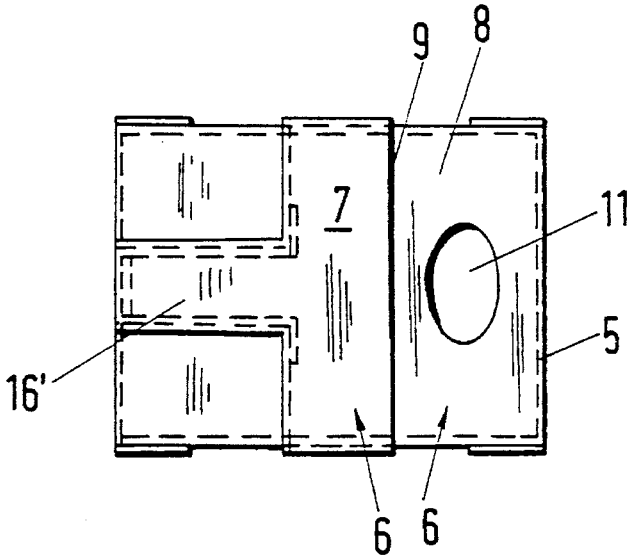
Fig.6c

Fig.9a
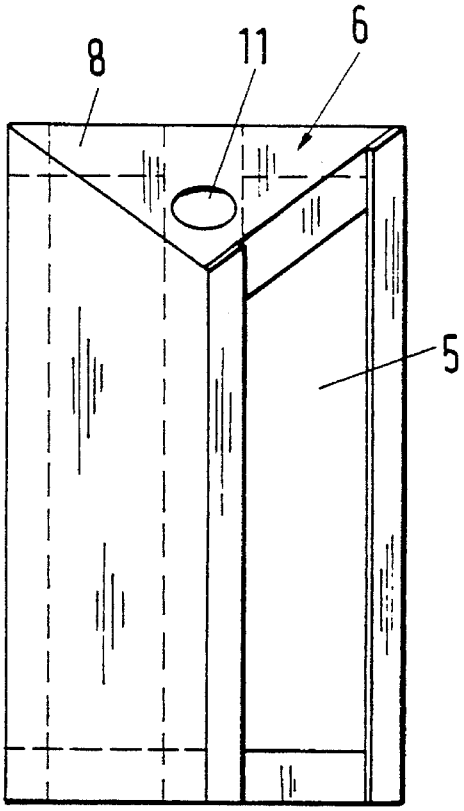
Fig.9b
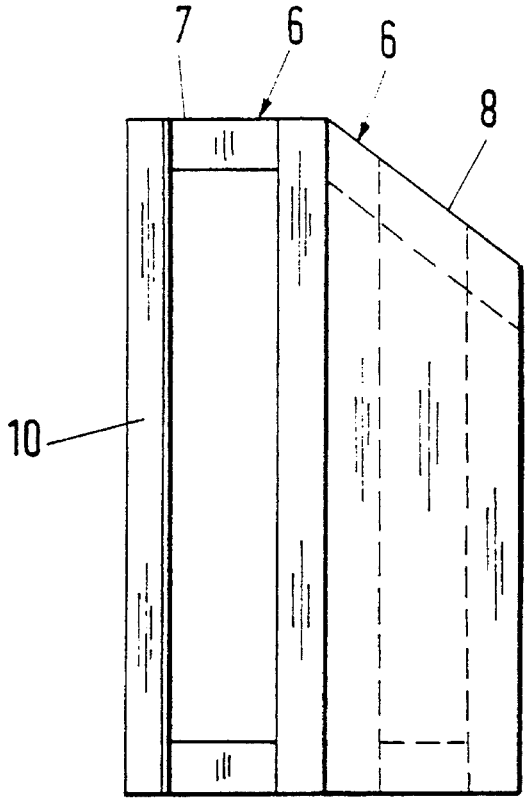
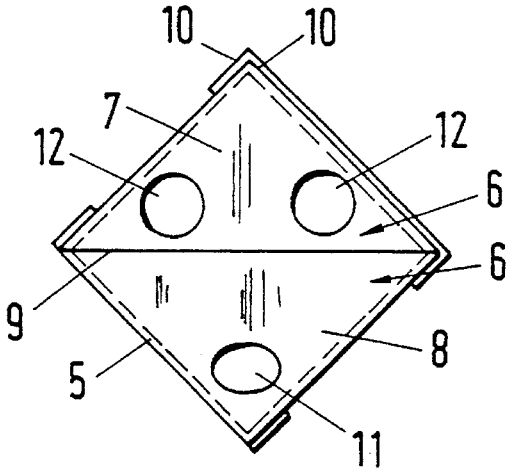
Fig.9c

Fig.12a
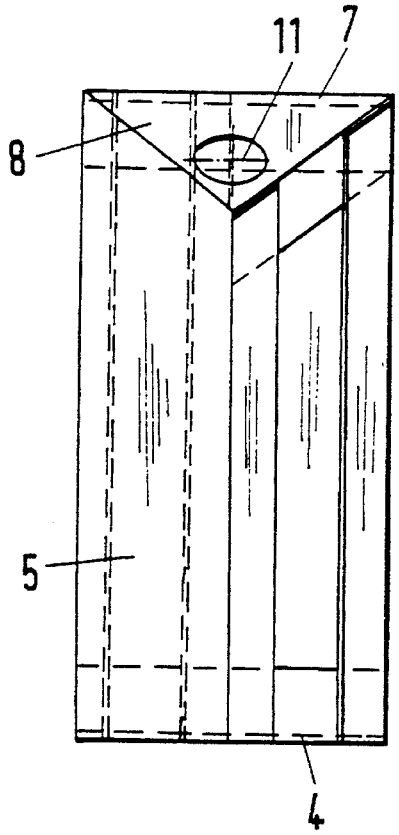
Fig.12b
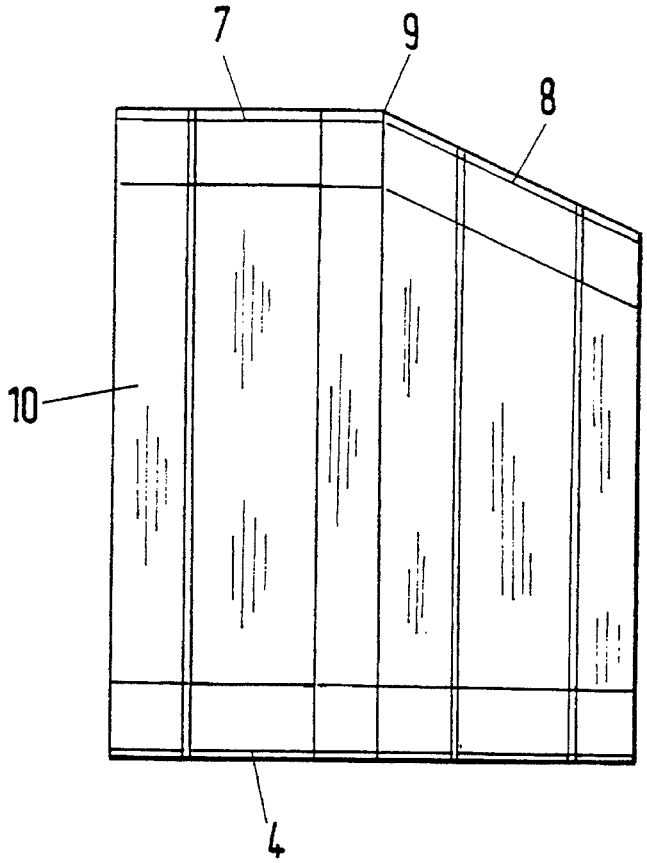
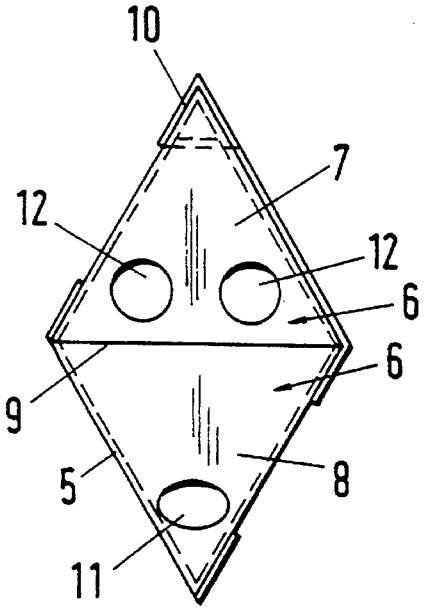
Fig.12c s10
s11
8
9
10
11
5
7
c
d
e 7
8
4
i 5
15

Fig. 16

| a | b | c | d | e | f | g | h | i | j | k | l | α | β | γ |
|---|---|---|---|---|---|---|---|---|---|---|---|---|---|---|
| 110.0 | 260.0 | 95.3 | 31.5 | 8.5 | 33.3 | 31.8 | 12.0 | 29.5 | 33.3 | 89.3 | 35.0 | 60.0 | 75.0 | 3.0 |
| s1 | s2 | s3 | s4 | s5 | s6 | s7 | s8 | s9 | s10 | s11 | s12 | s13 | s14 | s15 | s16 |
| 260.0 | 355.3 | 615.3 | 110.0 | 226.7 | 33.3 | 35.0 | 31.5 | 8.5 | 190.5 | 110.0 | 55.0 | | | | |

PACK FOR LIQUIDS WITH BAG

The invention relates to a pack for liquids, having a supportive covering and a flexible bag arranged therein with a closable pouring device, wherein the supportive covering has a bottom, a side wall and a top wall.

For various reasons and for various purposes, a number of different designs of packs for liquids with bags and supportive coverings have already been developed and some have been marketed. Therein, the majority of this known type of pack for liquids is known as a "Bag in Box". The "box" acts as a supportive covering or supportive body, since packs exist which have an outer support and also an inner protection. The bags used with most known packs are made of flexible plastics material.

Within the domain of packs for liquids, the skilled person has been looking for practical packs because these are most preferable for use by the end consumer and because such designs of pack also sell well. Manufacturing specialists are also trying to save on materials or to reduce manufacturing costs by the material selected. Often, the various aims cannot be reconciled with each other, and a great number of cheap packs are awkward to use.

Another aspect, namely friendliness to the environment, is a prime consideration amongst pack manufacturers. Multi-component packs often pose problems since the parts of the pack are made of different materials and are not easy to separate.

The aim of the invention is therefore to improve a pack for liquids of the kind mentioned in the introduction in such a way that the pack is easy to handle, has good distribution properties and can be manufactured economically and is made of materials which can already be recycled and which, above all, are able to be recycled.

This problem is solved according to the invention in that the supportive covering is designed as a rigid framework, the top wall of which has a flat first wall zone parallel to the flat bottom and a flat second wall zone which is disposed at an angle thereto, the wall zones being placed adjacently to each other along a first broken line, the second wall zone being joined to the bottom by way of the side wall and the first wall zone being joined to the bottom by way of a limb, the second wall zone disposed at an angle has a hole for passage therethrough of the pouring device arranged on the bag, and the bag is secured to the second wall zone and preferably also to the bottom. The supportive framework is at the centre of the invention. It surrounds the flexible bag, but due to the frame-like structure it is possible to look through it and see the bag. By breaking up the wall zones of the known box-like pack, it is clear that less material is used. However, the bag is still carried by the supportive framework and is protected and held on the outside. The flat and partly mutually parallel wall zones mean that the pack for liquids according to the invention has good distribution capabilities for it can be stored well and can therefore be transported in space conserving manner. The skilled person will see that a pack for liquids which is designed in accordance with the teaching of the invention is economical, makes savings on material, and, above all, is able to be made of materials which are friendly to the environment and which can be recycled and which can already be recycled.

Worthwhile improvements are therefore made to most known packs, particularly since the supportive framework according to the invention can also have additional means which are advantageous in terms of handling of the pack both for the manufacturer and also for handlers and end consumers.

A preferred embodiment of the pack for liquids according to the invention is characterised in that the supportive framework has a handle which is formed by two mutually vertical limbs, one of which is joined to the bottom and the other of which is joined to the first wall zone of the top wall. The supportive framework surrounds the bag in such a way that the latter is protected, carried and supported, and it is evidently particularly advantageous if a section of the supportive framework is designed at least partly as a handle. Here too, low consumption of material and the good handling capacity of the new pack are evident to the skilled person. Stability of the handle is promoted, in particular, by the two mutually perpendicular limbs which are fixed parts of the supportive framework, and which, despite the fact that a section is designed as a handle, has not lost its rigidity, but is fully able to carry out its supportive function for the bag.

According to another simplified embodiment of the invention provided in the first wall zone of the top wall are holes, at least 13 mm in diameter, in the form of finger holes. Tests have shown that in practice holes arranged in the flat first wall zone of the top wall which are preferably circular and 15 mm in diameter make it much easier to hold the pack at the top. During transportation it has been shown that supportive frameworks of an approximately quadrilateral shape can be stored in very space conserving manner or can also be placed adjacently to each other on a truck or on pallets. The holes in the wall zone of the top wall then make it very easy for the handler to hold a pack at the top and to take one individual pack out at the top.

It is also expedient according to the invention if the bottom and/or the first wall zone of the top wall is/are joined by way of a second broken line to a reinforcement zone. Flat surfaces are reinforced in the known way by flat neighbouring zones pivotally attached thereto. Often, the bottom has to hold the main part of the weight of the contents of the pack, and a reinforcement zone connected by way of the second broken line is responsible for improving the supporting properties. In addition, the reinforcement zone can be arranged on the one side of the bottom, and the side wall can be arranged on the other side of the bottom, e.g. on the oppositely disposed side of the bottom, so that a bag disposed inside it is particularly well supported.

It is also advantageous according to The invention if the bottom and/or some walls and/or zones are flat and are joined to reinforcement flaps disposed at an angle thereto. The strength and rigidity of the supportive framework according to the invention is further improved by way of these flaps, without the concept of the invention, namely support of the bag by way of a framework, being lost. Features which use less material are therefore created which strengthen the walls of the supportive covering and likewise the material.

A supportive framework of this kind is characterised with a particularly preferred embodiment in that the bottom, side wall, first wall zone of the top wall and limb are arranged transversely to one another and outwardly embrace the bag. Particularly simple manufacture results if the individual walls are arranged vertically to each other. As already customary in folding technology with folding bodies, the individual walls are successfully reinforced according to the invention by simple folding operations by way of walls or flaps placed transversely with respect to each other.

Supportive frameworks of this kind can be manufactured in a particularly economical way if the material is cardboard, paperboard, preferably corrugated cardboard, and possibly also stainless steel.

The use of corrugated cardboard is particularly favourable in terms of being friendly to the environment, for it can consist up to 100% of recycling material. The same is also true with respect to the other materials, even for plastics material. A preferred combination of materials is in the form of a supportive framework made of corrugated board and a bag made of plastics material. Both can be joined together in such a way that filling up, storage and transportation and also handling are promoted and practical, and, in particular, emptying, despite the fact that the end consumer can easily separate both parts after the pack according to the invention has been completely emptied. As can be seen, recycling the individual portions of material is very environmentally friendly. A supportive framework of this kind can be used to create a one-way pack, but supportive frameworks of correspondingly stable design can also be re-used a number of times, i.e. can be returned to the handlers, fillers or manufacturers, so that the manufacturers and fillers only have to add a bag to them.

The last mentioned concept is important if the supportive framework is designed for re-use, wherein it could then be made of plastics material or even stainless steel.

If cheap materials such as paperboard or corrugated cardboard are used, it is expedient according to another embodiment of the invention if the flat walls and zones of the supportive framework have grooves or ribs. These are easily made in the materials of the supportive framework at the manufacturing stage, when the material for the supportive framework is still in web form prior to assembly. The manufacturer will then, in the known way, provide cutting lines, grooves and also ribs for reinforcement, folding over purposes, and the like.

It is also advantageous, if, according to the invention, the bag is made of plastics material, e.g. a polymer, and if the pouring device which is made of plastics material is injected or sealed to the bag. Here, various forms of pouring device can be used, e.g. two-component devices, one part of which is designed as a collar for filling of pouring and has to be injected or sealed to the bag; and the other part of which is provided for the purpose of closing the collar, e.g. in the form of a snap-shut connection, clamping means or a screw on means.

A pack for liquids which is designed according to the invention is therefore environmentally-friendly in a number of respects: firstly, replacing a box which surrounds the bag with a frame makes savings on material. Secondly, the material can be in the form of raw materials which can be recycled, for example from corrugated board which is up to 100% a recyclable material. Thirdly, the materials for the supportive framework itself can be recycled. Also, the new pack is appealing to the end consumer because he can see through the bag, and possibly see the contents, through the openings in the frame. After the pack has been emptied, the end consumer is able to separate the two parts of the pack, namely the supportive framework, on the one hand, and the flexible bag, on the other hand, with a handle and can advantageously dispose of it appropriately. The frame of the supportive covering of the pack according to the invention makes the pack easy to handle, even in the case of embodiments not designed with a special handle.

Apart from the environmentally friendly features of the pack, the manufacturer recognises that practical machines can be used, e.g. that the inner bag can be assembled in a technically reliable way and in an economically favourable way, and provided and manufactured with the single opening device of the pack according to the invention. Practice has shown that even the filling operation is faster and therefore gives a higher output. For example, in the manufacturing machine, a conveyer is able to hold the inner bag on the opening device, whereby the opening device provides synchronisation of the machine. Therefore, in the case of milk packs a cost-effective and fast filling machine results which is what every dairy wants. Various designs of inner bag can be used. For example, additional sealing seams can be arranged in simulating manner (in addition to the genuine longitudinal sealing seam) on the inner bag, in order to shape the bag so that it is approximately square shaped. It is also possible to sterilise the inner bag, e.g. to arrange the closure means on the end of the inner bag with aseptic manufacture. The filling operation into the filling machine can be done under aseptic conditions, for example, by cutting open and filling the pack through the closure means, in a dairy, for example, if milk is the liquid being filled. The bag is preferably made of polyethylene. The pouring device is also made of plastics material, preferably a material which is compatible with the material of the bag, most frequently polyethylene.

Depending on the product to be packed, or depending on market requirements, the inner bag can be made of various kinds of polymer film. Therein, it is possible to consider properties in terms of preventing the penetration of oxygen, preventing the penetration of light, transparency and preventing the escape of aroma. The inner bag can, for example, be manufactured so that it is in the form of a strip of bags arranged behind one another, and can be provided with closure means, wherein the plastics film is injected or sealed to the pouring device.

The supportive frame is preferably of rectangular cross-section with straight sides, and is provided with cutting lines, folding lines and holes, e.g. for passage therethrough of the pouring device or for finger openings, is set upright and either folded over the empty or filled inner bag and then closed or closed first of all, wherein the inner bag is placed into the ready supportive frame either empty or full, and is secured to it. Various commercial applications can easily be arranged on the outside of the supportive framework.

Figure 3:
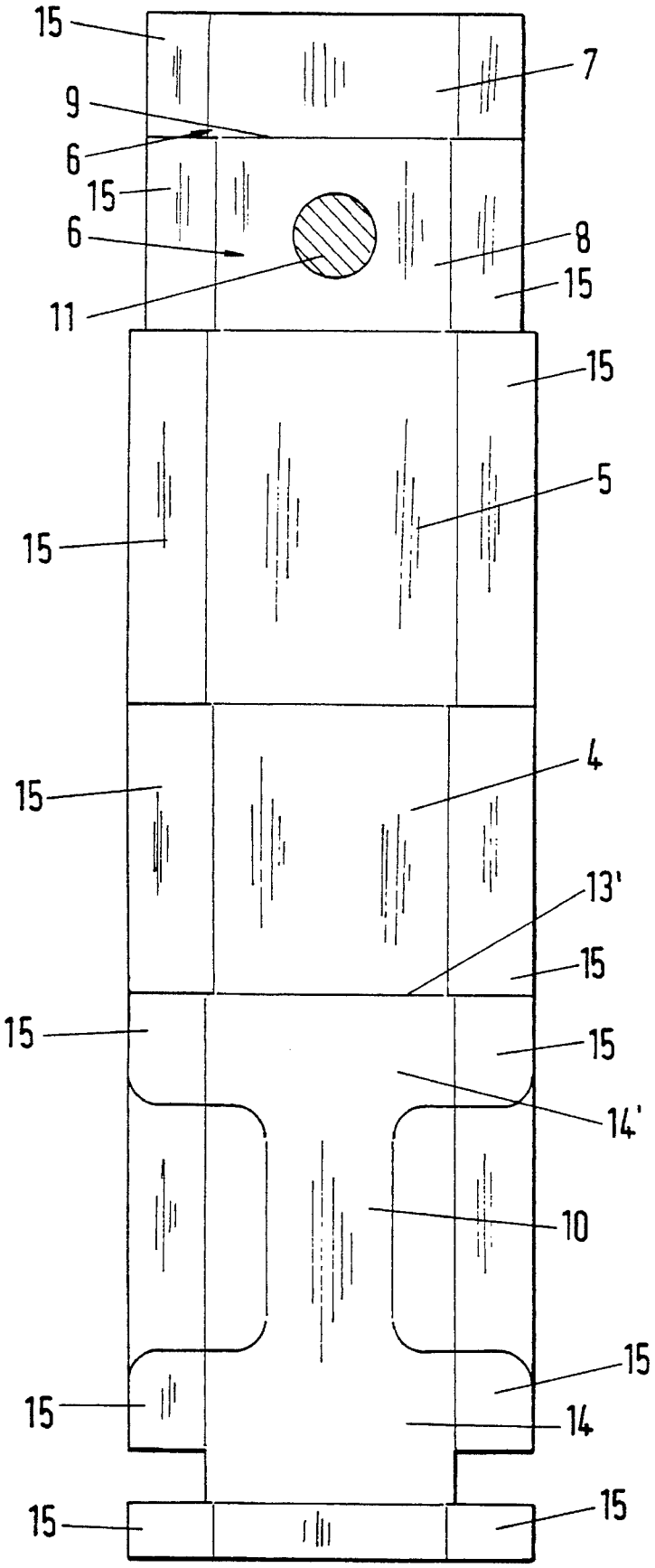
Figure 4:
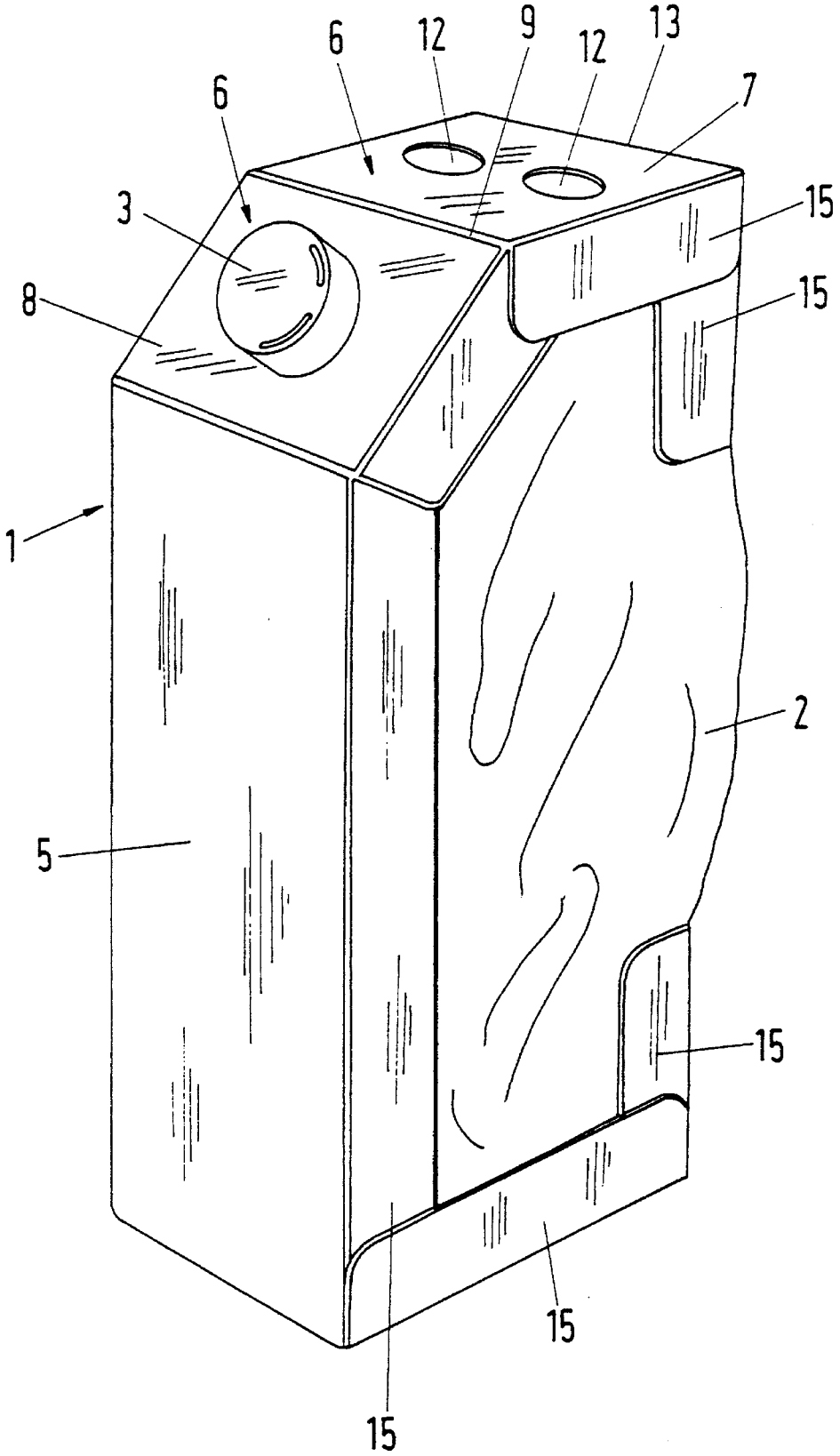
Figure 5:
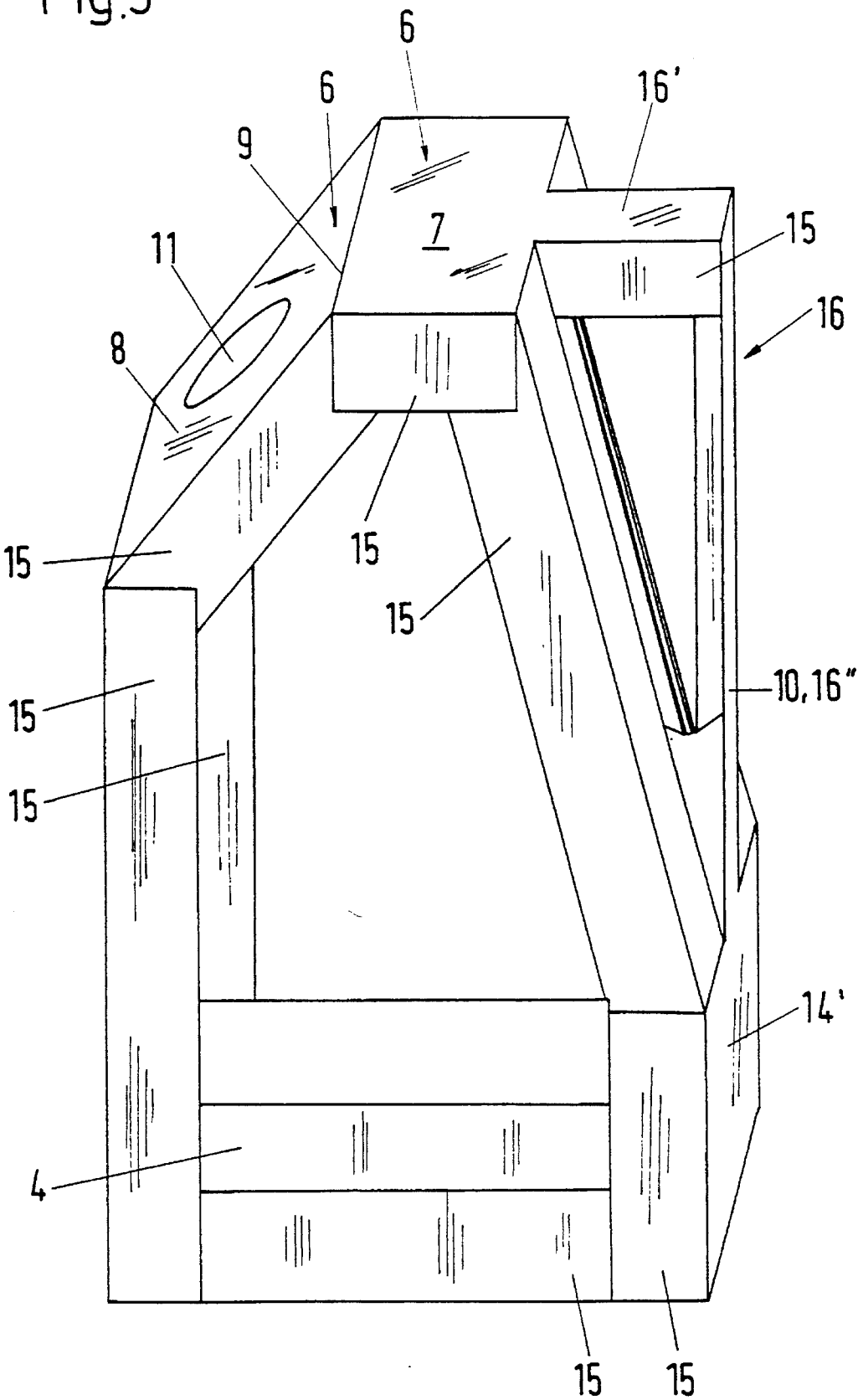
Figure 7:
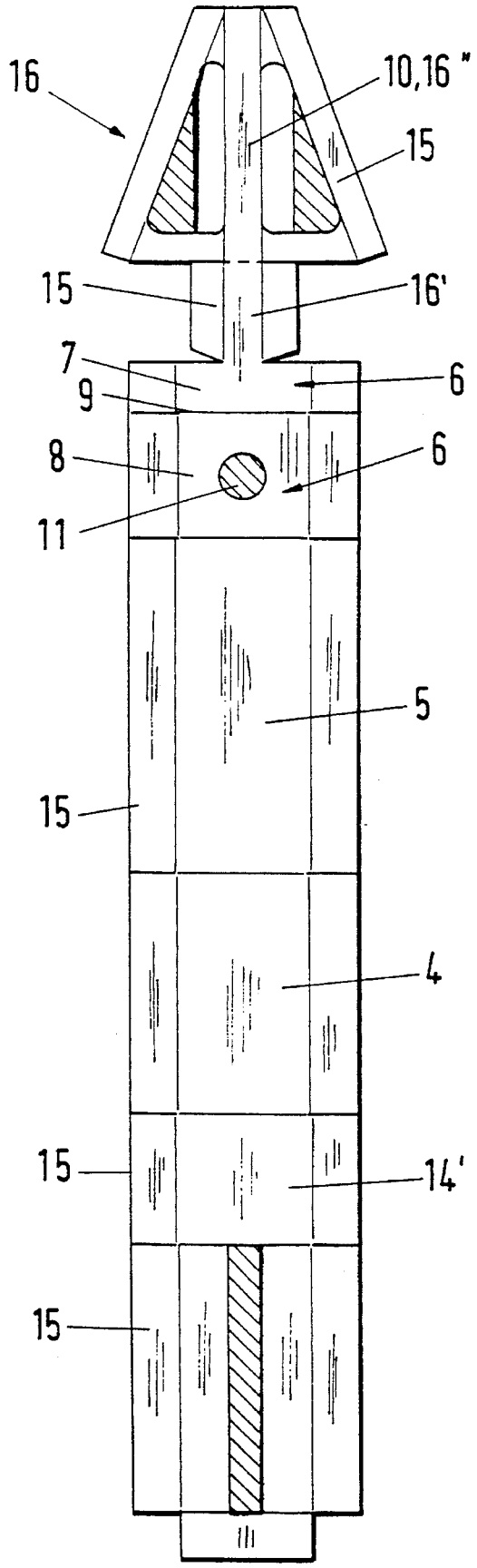
Figure 8:
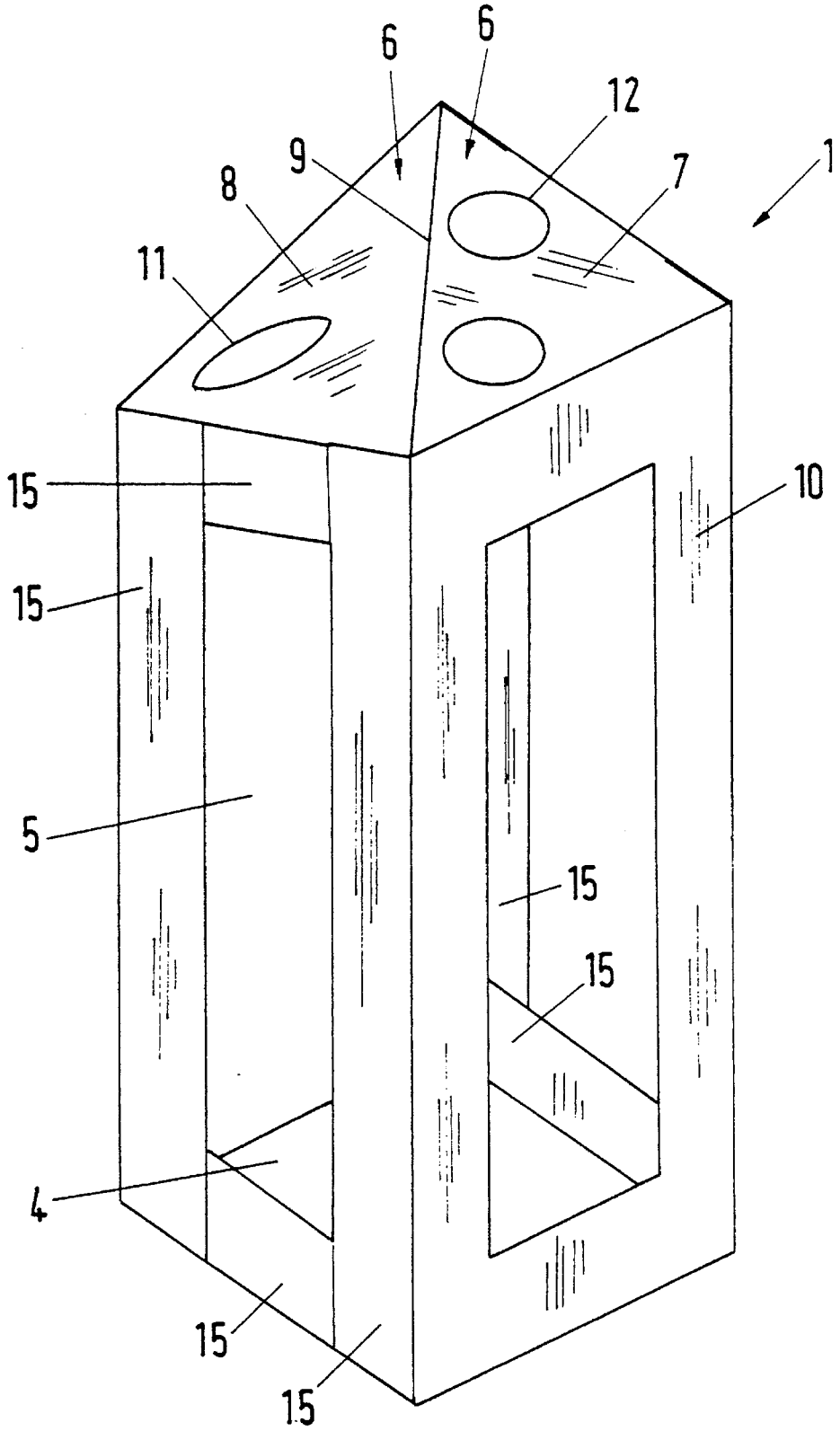
Figure 10:
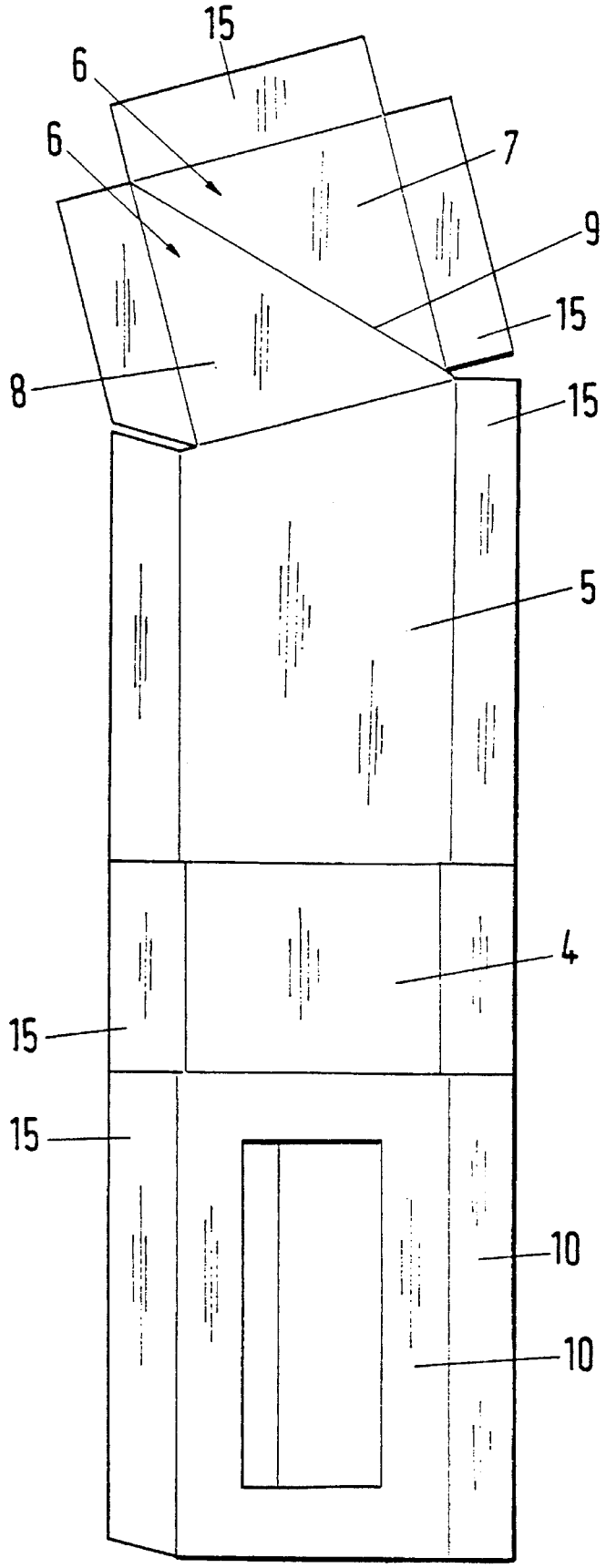
Figure 11:
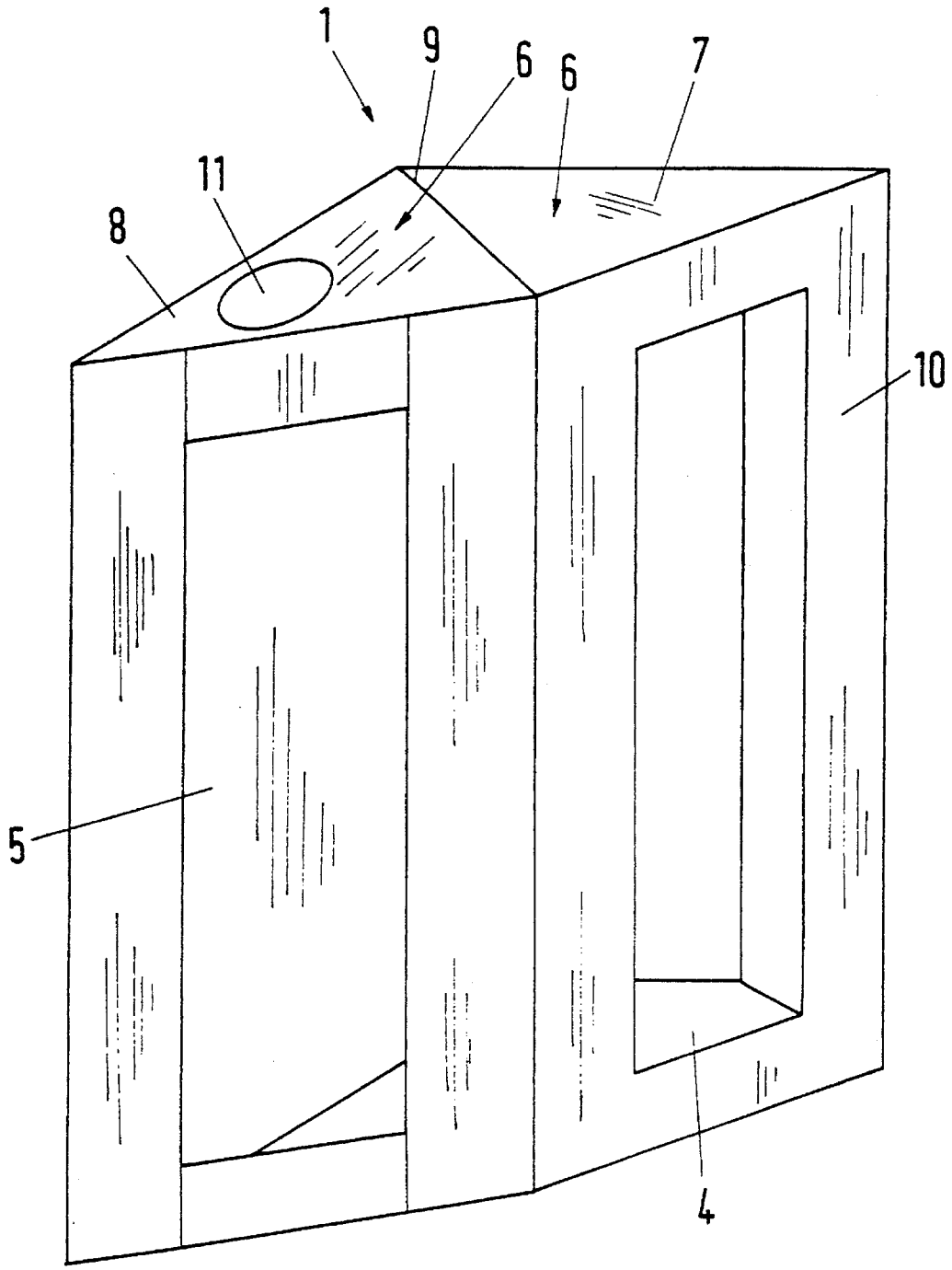
Figure 13:
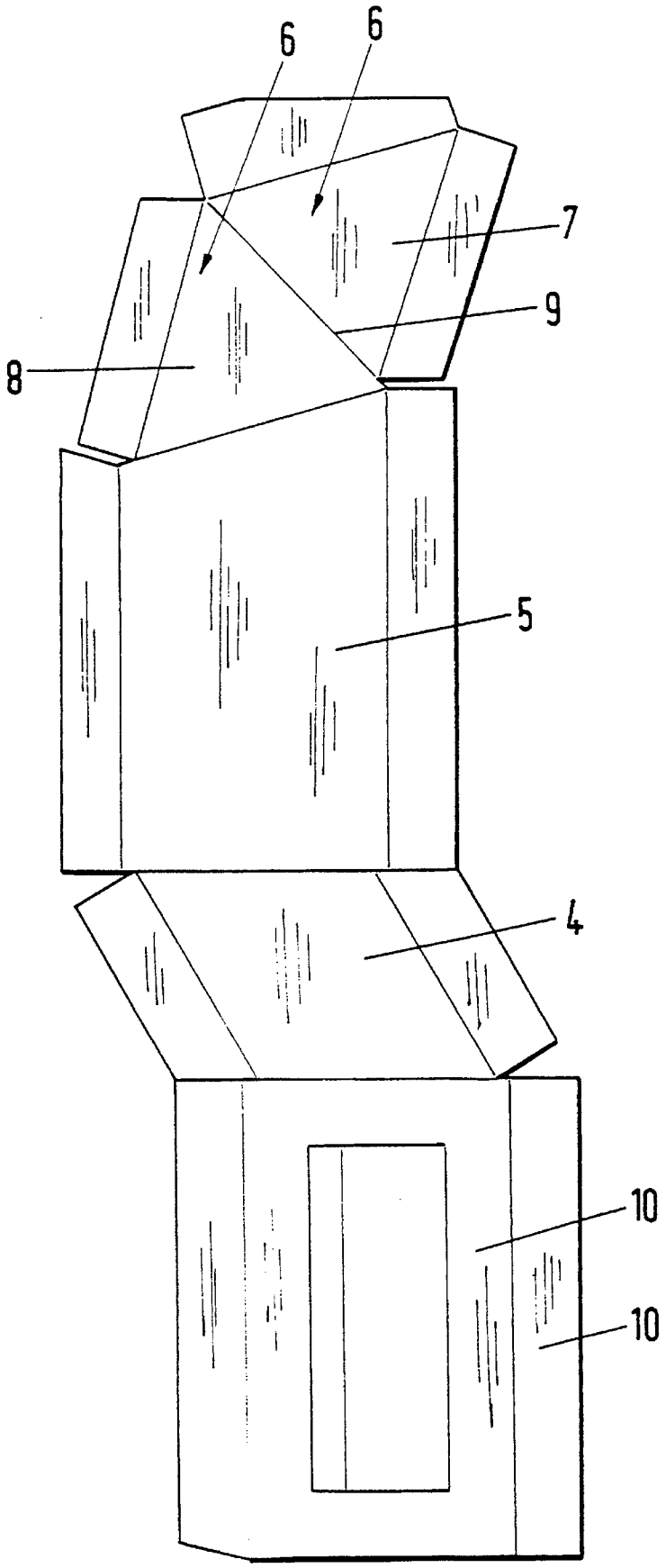
Figures 14A, 14B, 14C:
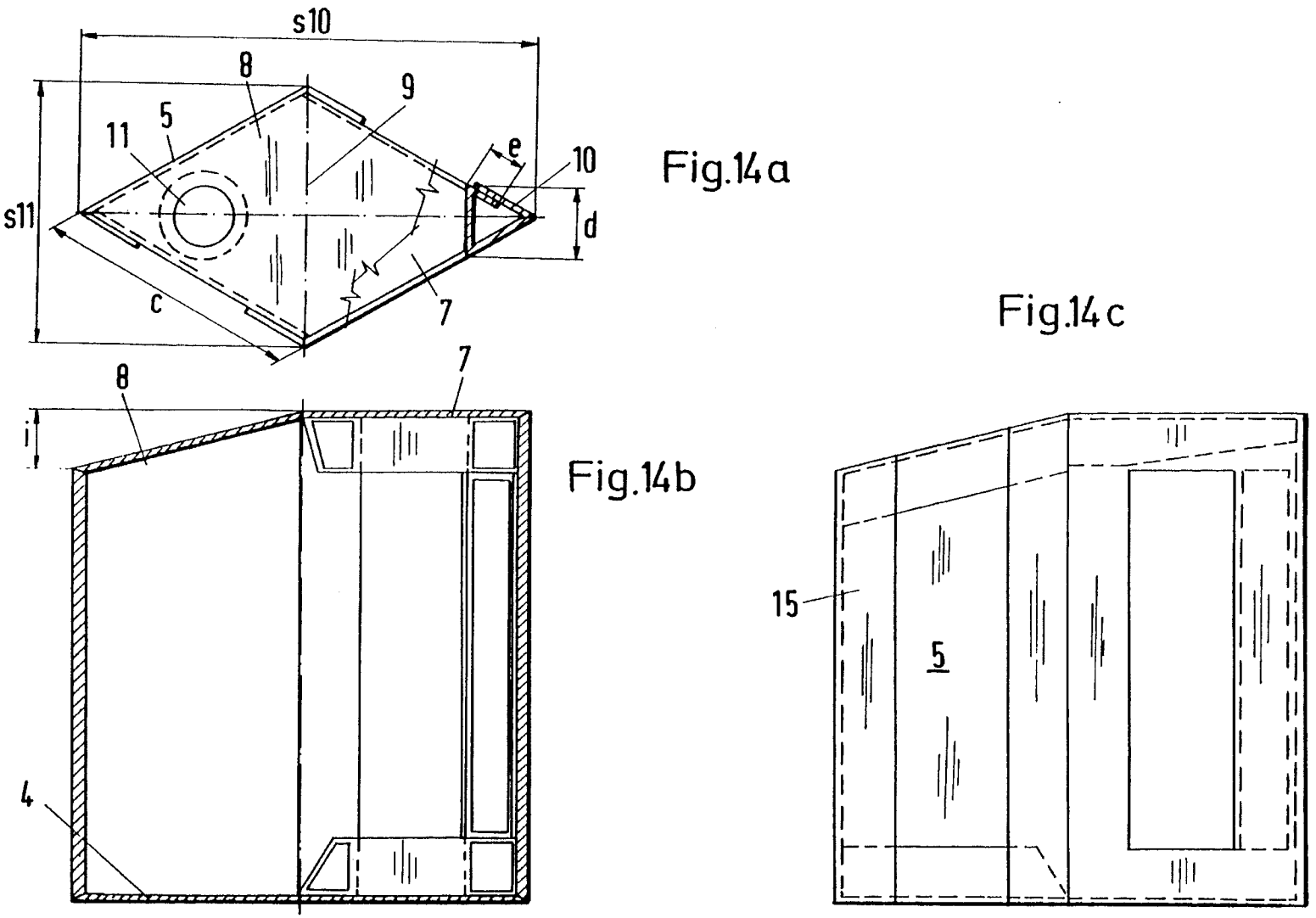
Figure 15:
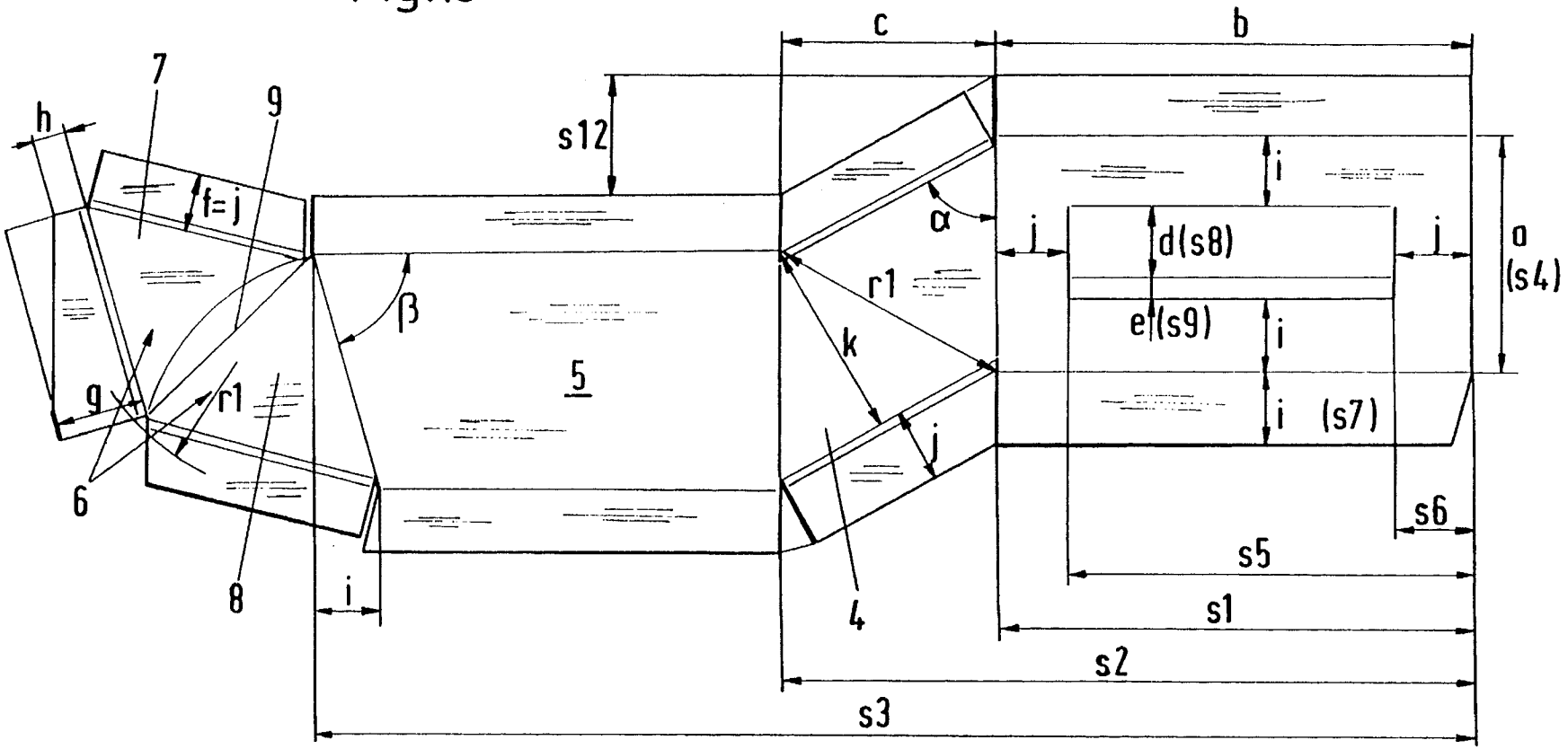

Further advantages, features and possible applications of the present invention will emerge from the following description in connection with the drawings which show four preferred embodiments of the pack according to the invention which shall be considered as examples. In the drawings:

FIG. 1 shows in perspective the supportive framework of a first embodiment which is made of corrugated cardboard, for example, FIGS. 2*a*, 2*b* and 2*c* are the side view, rear view and plan view respectively of the supportive framework according to FIG. 1, FIG. 3 shows the folded out blank for the supportive framework according to FIGS. 1 and 2*a* to 2*c*, FIG. 4 is a ready, filled and closed pack with a supportive framework of the embodiment according to FIGS. 1 to 3, wherein two finger holes are arranged additionally at the top of the first wall zone, FIG. 5 is a view in perspective of a second embodiment of a supportive framework with a handle, FIGS. 6*a*, 6*b* and 6*c* are the side view, rear view and plan view respectively of the supportive framework according to FIG. 5, FIG. 7 is the folded out blank for the supportive framework according to FIG. 5, FIG. 8 is a third different embodiment of the supportive framework in perspective, FIGS. 9*a*, 9*b* and 9*c* are the rear view, side view and plan view of the supportive framework of FIG. 8, FIG. 10 is a folded out blank for the supportive framework of FIG. 8, wherein, however, the holes have been omitted from the top wall, FIG. 11 is a fourth embodiment of the supportive framework which can likewise be made of corrugated cardboard, FIGS. 12*a*, 12*b* and 12*c* are the rear view, side view and plan view respectively of the supportive framework according to FIG. 11, but in FIG. 12*c* the upper wall is provided additionally with two finger holes, FIG. 13 shows the folded out blank for the supportive framework of FIG. 11, wherein the holes have been omitted from both zones for the top wall, FIGS. 14*a*, 14*b* and 14*c* are similar views to those in FIGS. 12*a* to 12*c*, but giving dimensions, FIG. 15 shows the folded out blank for the supportive framework of the embodiment in FIG. 11, like in FIG. 13, but with dimensions, and FIG. 16 is a table giving the dimensions of one particular concrete embodiment of a supportive framework according to FIG. 11.

The embodiments shown and described here by way of example are packs for liquids whose supportive covering 1 is in the form of a rigid framework. FIG. 4 shows the ready pack with a flexible polyethylene bag 2, with closed pouring device 3, arranged in the supportive framework 1. The pouring device can be a snap-shut closure means or a screw cap. A more detailed description of the embodiments of the various pouring devices 3 is not given here because means known per se can be used. Expediently, an inner polyethylene nipple is welded to the polyethylene bag 2 and is pushed through a hole yet to be described. Then, if a screwthread is provided, a screw cap is screwed onto the outside of the supportive framework 1, as shown in FIG. 4, so that the flexible inner bag 2 is already fixed at the top to the supportive framework 1 by these measures by the pouring device 3.

The supportive framework 1 has a bottom 4, a side wall 5 and a top wall which is generally denoted by the reference numeral 6. The top wall 6, in turn, consists of a flat first wall zone 7 which is disposed parallel to the flat bottom 4, and a flat second wall zone 8 which is disposed at an angle thereto. The wall zones 7 and 8 are joined together by way of a straight first broken line 9.

With the first embodiment in FIGS. 1 to 4, the second wall zone 8 which is disposed at an angle of 45° relative to the first wall zone, is arranged at an angle of about 45° to the side wall 5 and is joined by way of that wall to the bottom 4, wherein an angle of 90° is formed between the side wall 5 and the bottom 4 in the cross-sectional view in FIG. 2*a*. The first wall zone 7 of the top wall 6 is joined to the bottom 4 by way of a limb 10 which is disposed in a plane parallel to that of the side wall 5.

With the other three embodiments too, a limb 10 is indicated, wherein, however, it is of a different design. With the embodiment in FIG. 5, the plane of the limb is admittedly parallel to the plane of the side wall 5, but with the embodiments according to FIGS. 8 and 11 this latter feature is no longer present, because in that embodiment the limb 10 is formed by two elongate wall zones which are disposed at an angle of preferably 90° to each other (FIG. 8) or which enclose a more acute angle (FIG. 11, FIG. 12*c* rhombus). Nevertheless, with the embodiments according to FIGS. 8 and 11, the connection between the bottom 4 and the top wall 6 on the side which is substantially oppositely disposed to the side wall 5 can be said to form a limb 10.

The second wall zone 8 of the top wall 6 is disposed at an angle in such a way out of the plane which is parallel to the bottom 4, along the afore-mentioned first broken line 9 (with the embodiment in FIGS. 11 to 15: 15° ) that the outermost and frontmost tip of the second wall zone 8 remains within the quadrilateral outer contour of the pack as a whole, with the result that the height of the side wall (e.g. b-1 on the front side, FIG. 15) is less than the distance between the bottom 4 and the first wall zone 7. As a result, a space is produced above the second wall zone 8, disposed at an angle, between the two planes of the bottom 4, on the one hand, and of the first wall zone at the top, on the other hand, and the pouring device 3 can be accommodated in this space in such a way that it does not project from the outer contour of the entire pack, as can be seen in the side view or front view of the pack in FIG. 4. This feature is advantageous in that its purpose is to enable good distribution because the packs are able to be stacked well.

The second wall zone 8 has a hole 11 for the pouring device 3 arranged on the bag 2 to pass through. The point where the flexible bag 2 adheres to the inner surface of the bottom 4 of the supportive framework 1 is not shown in the drawings. It is easy for the reader to imagine, however. With the embodiment shown in FIGS. 4 and 8 further holes 12 are provided in the first wall zone 7 of the top wall 6 fop finger holes, wherein owing to the size of the holes to take the fingers of one hand, it has been seen as practical to have two adjacent holes.

With the embodiment according to FIGS. 1 to 4, the first wall zone 7 and also the bottom 4 are joined by way of a second broken line 13, 13' to an upper reinforcing zone 14 or lower reinforcing zone 14'. In FIG. 3, from the view of the blank from the bottom to the top, it can be seen that the reinforcement zone 14 makes a transition into the limb 10 and that at the top this makes a transition into the other reinforcement zone 14'. From the upright supportive framework 1 in FIG. 1 it can be seen that in this way the limb 10 has a handle. The limb can be securely fixed at the top and bottom because the tensile forces and compressive forces during use are distributed through the reinforcement zones 14, 14' and are diverted more uniformly to the respective outer zones (bottom 4, first wall zone 7).

Practically all embodiments of the supportive framework are also reinforced by reinforcement flaps 15 which are folded in at the sides of the bottom 4 and/or the side wall 5, top wall 6 and/or other wall zones 7, 8 and/or even a limb 16'.

This latter limb 16' results particularly with the embodiment in FIGS. 5 to 7, where the supportive framework is provided with a handle 16. The handle 16 is formed from two mutually vertical limbs 16' and 16". The one limb, the limb 16" which is joined to the bottom 4 by way of the bottom reinforcement zone 14' is vertical to the other limb 16' which is joined integrally and continuously to the first wall zone 7 of the top wall 6.

With the embodiment in FIGS. 8 to 10, the sides which join together the bottom 4 and the top wall 6 consist on the one hand, of the afore-mentioned side wall 5 with three mutually vertical outer edges and a fourth short inclinedly disposed outer edge and also three structures in the form of a window frame, which are formed by the reinforcement flaps 15, of which one flap is part of the aforementioned limb 10. The corresponding blank is very simple, as can be seen in FIG. 10, wherein the top wall 6 does not have the holes denoted by the reference numerals 11 and 12.

The embodiment in FIGS. 11 to 15 of the supportive framework 1 is similar to FIG. 8. The difference basically exists in the type of base or bottom, as shown by a comparison of FIGS. 9*c* and 12*c*. The blank of FIG. 13 is of a correspondingly different design, wherein the top wall 6 does not have the hole 11 shown in FIG. 11 and does not even carry the two holes 12 shown additionally in FIG. 12 for the finger holes.

FIG. 16 requires no further description, for it is merely a table giving the individual dimensions of the concrete embodiment according to FIGS. 14*a* to 15. The "Flap" mentioned in Columns 5 to 8 etc. of the table in FIG. 16 is the afore-mentioned flap.

I claim:

1. A pack for liquids, having a supportive covering and a flexible bag arranged therein having a closable pouring device, wherein the supportive covering has a bottom, a side wall and a top wall, characterized in that the supportive covering is designed as a rigid framework, the top wall of the framework has a flat first wall zone parallel to the bottom and a flat second wall zone which is disposed at an angle to the first wall zone, the first and second wall zones being positioned adjacent to each other along a first broken line, the second wall zone being joined to the bottom by way of the side wall and the first wall zone being joined to the bottom by way of a limb portion, the second wall zone disposed at an angle has a hole for passage therethrough of the pouring device arranged on the bag, and that the bag is secured to the second wall zone.

2. A pack according to claim 1, characterized in that the supportive covering has a handle which is formed by the limb portion comprising two mutually perpendicular limbs, one of the limbs being joined to the bottom and the other of the limbs being joined to the first wall zone of the top wall.

3. A pack according to claim 1, characterized in that finger holes are provided in the first wall zone of the top wall, the finger holes being at least 13 mm in diameter.

4. A pack according to claim 1, characterized in that reinforcement zones are located adjacent to the bottom and the first wall zone of the top wall, and that the bottom and the first wall zone of the top wall are each joined by way of a respective second broken line to an adjacent reinforcement zone.

5. A pack according to claim 1, characterized in that the bottom, side wall, top wall, and first and second wall zones are flat and are joined to angularly disposed reinforcement flaps.

6. A pack according to claim 1, characterized in that the bottom, side wall, first wall zone of the top wall, second wall zone and limb (10) are arranged transversely to one another and surround the outside of the bag (2).

7. A pack according to claim 1, characterized in that the supportive covering is made of one of cardboard, paperboard, plastics material or stainless steel.

8. A pack according to claim 1, characterized in that the bottom, side wall, top wall, and first and second wall zones of the supportive covering have grooves.

9. A pack according to claim 1, characterized in that the bag is made of plastics material and the pouring device is made of plastics material which is sealed to the bag.

10. A pack according to claim 1 characterized in that the bag is secured to the bottom.

11. A pack according to claim 7 characterized in that the supportive covering is made of corrugated cardboard.

12. A pack according to claim 1 characterized in that the bottom, side wall, top wall, and first and second wall zones of the supportive covering have ribs.

* * * * *

UNITED STATES PATENT AND TRADEMARK OFFICE

CERTIFICATE OF CORRECTION

PATENT NO. : 5,482,179

DATED : Jan. 9, 1996

INVENTOR(S) : Krister Bruhn

It is certified that error appears in the above-indentified patent and that said Letters Patent is hereby corrected as shown below:

On title page, item (73) Assignee:, line 1 change "Tetra Layal Holdings & Finance S.A." to --Tetra Laval Holdings & Finance S.A.--.

Signed and Sealed this

Twenty-sixth Day of March, 1996

*Attest:*

Bruce Lehman

BRUCE LEHMAN

*Attesting Officer*

*Commissioner of Patents and Trademarks*